US005501658A

United States Patent [19]

Frye

[11] Patent Number: 5,501,658

[45] Date of Patent: Mar. 26, 1996

[54] MASSAGE TABLE ROLLER MECHANISM

[76] Inventor: Paul E. Frye, Rte. 3, Doniphan, Mo. 63935

[21] Appl. No.: 254,370

[22] Filed: Jun. 6, 1994

[51] Int. Cl.[6] ..... A61H 15/00

[52] U.S. Cl. ..... 601/99; 601/84; 601/90

[58] Field of Search ..... 601/24, 49, 51, 601/52, 63, 84, 98, 99, 115–117, 89–92

[56] References Cited

U.S. PATENT DOCUMENTS

| | | | |
|---|---|---|---|
| 2,841,141 | 7/1958 | Hudgins | 601/116 |
| 2,884,923 | 5/1959 | Buffalow | 601/116 |
| 2,909,173 | 10/1959 | Anderson | 601/116 X |
| 3,039,458 | 6/1962 | Hill | 601/116 |
| 3,640,272 | 2/1972 | Hussey | 601/99 |
| 3,877,422 | 4/1975 | Heuser et al. | 601/116 |
| 4,586,493 | 5/1986 | Goodman | 601/116 |
| 5,088,475 | 2/1992 | Steffensmeier | 601/116 |
| 5,165,390 | 11/1992 | Fleetwood | 601/128 X |

*Primary Examiner*—Robert A. Hafer
*Assistant Examiner*—Brian E. Hanlon
*Attorney, Agent, or Firm*—Polster, Lieder, Woodruff & Lucchesi

[57] ABSTRACT

A roller mechanism is provided for a massage table which will allow a roller to accurately follow the curvature of a patient's back, and which will maintain a substantially constant pressure on the patient's back. The roller mechanism includes a roller assembly frame which slides beneath the table. A roller frame, on which the roller is journaled, is pivotally mounted to the roller assembly frame so that the roller may move vertically relative to the fame. A spring is connected at one end to an end of the roller frame and at another end to a bracket which is movable vertically relative to the roller assembly frame. The spring biases the pivotal roller frame upwardly to keep the roller in contact with the bottom of the table's cushion on which the patient lies. By changing the position of the bracket, the spring tension can be changed, to alter the pressure exerted by the roller against the patient's back.

10 Claims, 2 Drawing Sheets

MASSAGE TABLE ROLLER MECHANISM

BACKGROUND OF THE INVENTION

This invention relates to massage tables, and, in particular, to a roller mechanism for the table which will follow the curve of a patient's back and keep a substantially constant pressure applied to the patient's back.

Massage tables are often used by chiropractors to administer massages to patients. The tables typically include a cushion upon which the patient lies. A roller is provided beneath the cushion which will exert pressure against the patient's back. Typically, the roller is mounted on a frame which slides along the table beneath the cushion, so that the roller can be moved beneath the patient to massage the patient's back.

To provide a more even massage the roller preferably follows the curvature of the patient's back. The roller has, heretofore, been placed in a curved frame or slide which approximates the curve of a patient's back. The roller, when moved beneath the table, will then move along the curve defined by the slide, to apply pressure to the patient's back. However, not all backs are the same and the curvature of patients' backs may vary a great deal. The roller may thus apply too much pressure at certain points for some patients, and apply too little pressure for others. The use of the curved frame provides a satisfactory massage to only about half of the patients which receive massages. The remainder of the patients find the massage uncomfortable and of little benefit.

SUMMARY OF THE INVENTION

One object of this invention is to provide a massage table which will provide a more even massage to a patient.

Another object is to provide a roller mechanism for the massage table.

Another object is to provide such a roller mechanism which will exert constant pressure to a patient's back.

Another object is to provide such a roller mechanism which will more accurately follow the curvature of a patient's back.

Another object is to provide such a roller mechanism in which the pressure exerted on a patient's back may be easily altered.

These and other objects will become apparent to those skilled in the art in light of the following disclosure and accompanying drawings.

Briefly stated, a massage table of the present invention includes a table frame and a roller assembly slidably mounted to the table frame. The table frame has legs, a cushion supported on the table frame, and two generally straight and horizontal slides or tracks secured to the table frame beneath the cushion. The slides extend the length of the table between a front and a back of the table.

The roller assembly includes a roller assembly frame having a horizontal portion and a vertical portion. Wheels rotatably mounted to the horizontal portion are received in the table frame slides to allow the roller assembly to move along the table beneath the cushion. A roller is mounted to the roller assembly frame to exert pressure against a bottom surface of the cushion. The roller is rotatably mounted on a roller frame having elongate members and an axle extending between the tops of the elongate members. The roller is journaled on the roller frame axle. The roller frame is pivotally mounted to the horizontal frame portion so that the roller is movable vertically relative to the horizontal frame member. A stop is provided to prevent the roller from being raised too high. The pivotability of the roller frame allows for the roller to remain in contact with the bottom of the cushion even though the relative vertical position of the roller assembly frame remains constant. The roller is freely movable, so that the roller can more accurately follow the contours or curves of a patient's back.

A tensioning mechanism is provided to alter the pressure exerted by the roller against the cushion. The vertical frame portion includes two generally vertical members which depend from the horizontal frame member. A mounting plate is secured to, and extends between, the vertical members. A pair of spaced apart linear bearings or bars extend between the mounting plate and the horizontal frame portion. The tensioning mechanism includes a bracket slidably mounted to the linear bearings to be movable vertically. A tensioning member, such as a spring, extends between the bracket and the elongate members of the roller frame. Preferably, the springs are secured to the elongate members of the roller frame at an end of the members opposite the roller, and on an opposite side of the pivot point of the roller frame. Thus, when the bracket is lowered, the tension on the spring is increased, and the pressure exerted by the roller against the cushion is increased. Similarly, when the bracket is raised, the tension on the spring is reduced (the spring is relaxed) and the pressure exerted by the roller is reduced. The spring serves to bias the roller upwardly to keep it in contact with the bottom of the cushion and to keep the pressure exerted by the roller substantially constant. The spring works in conjunction with the pivotability of the roller frame to allow the roller to more accurately follow the curves of a patient's back.

A rotatable threaded bar extends between the mounting plate secured to the vertical members and the bracket. The bracket has an internally threaded opening or boss through which the threaded bar extends so that when the threaded bar is rotated, the bracket is moved along the linear bearings. The threaded bar may be rotated, for example, by a wheel or a reversible motor.

DESCRIPTION OF THE PREFERRED EMBODIMENT

Figure 1:
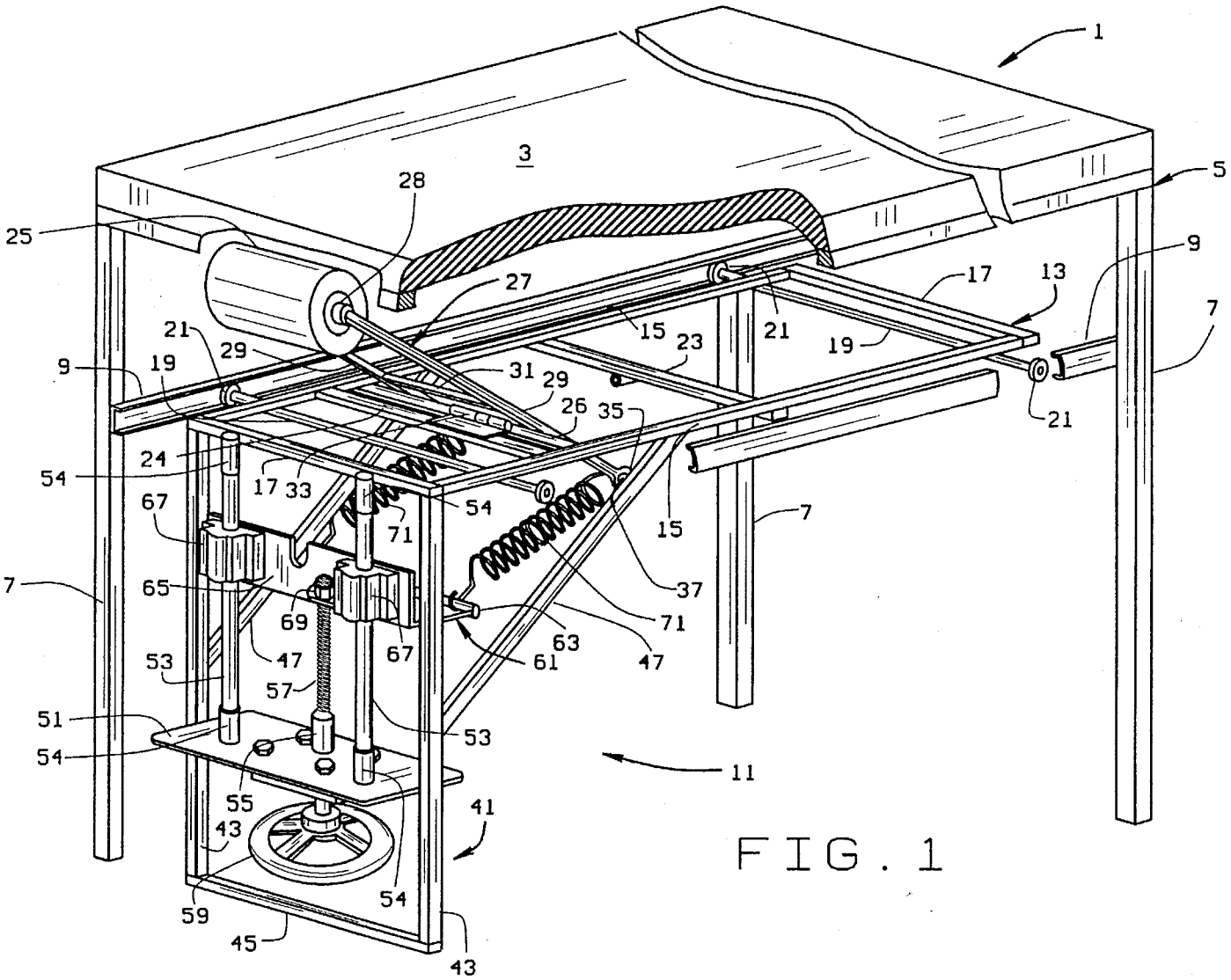
FIG. 1 is a perspective view, partially broken away, of a massage table incorporating a roller mechanism of the present invention.

An illustrative embodiment of a massage table 1 of the present invention is shown in FIG. 1. Table 1 includes a cushion upon which a patient may lie. The cushion 3 is supported on a table frame 5 having legs 7 and two elongate, substantially straight and horizontal slides or tracks 9 extending the length of the frame.

A roller assembly or carriage 11 of the present invention is provided beneath the cushion in a position to exert pressure upwardly so that a massage may be administered to a patient lying on the table. Assembly 11 has a horizontal frame portion 13 having side members 15 and front and back end members 17. A pair of axles 19 extend between, and beyond, the side members 15. Roller wheels 21 are rotatably journaled on the ends of the axles 19 and are received in the table frame slides 9 to allow roller assembly 11 to be easily moved along the length of the table. Axles 19 are preferably positioned near the frame end members 17. A reinforcing member 23 extends between side members 15 approximately midway between end members 17. A mounting plate 24 extends between side members 15 between the back of the frame 13 and member 23 and a stop 26, in the form of a bar, extends between the side members 15 forwardly of the mounting plate 24. Mounting plate 24 preferably is secured, such as by welding, to inner surfaces of frame side members 15 and stop 26 is preferably secured to the bottom of the side members. Thus, stop 26 is spaced below mounting plate 24.

A roller 25 is rotatably mounted on a roller frame 27 which it turn is pivotally mounted to the horizontal frame portion 13 so that the roller 25 will contact the bottom of cushion 3. Roller frame 27 includes two elongate, spaced apart members 29 which are joined at the top by an axle 28 which extends through roller 25 and about which the roller may rotate. A plate 31 extends between members 29 at a point approximately one-half between the ends of members 29. A hinge 33, having a pair of hinge plates, is secured by one of the hinge plates to plate 31 and by the other hinge plate to frame mounting plate 24, to pivotally secure roller frame 27 to the frame 13. Roller 25 can thus be moved vertically above the horizontal frame portion 13 in a path defined by an arc with hinge 33 at the center thereof. Roller frame members 29 preferably have ends 35, remote from roller 25, which are generally circular. An anchor bar or pin 37 extends horizontally from ends 35.

The elongate members 29 extend over and beyond stop 26. Stop 26 thus prevents roller 25 from being raised too far. The maximum height depends on the vertical and horizontal spacing between stop 26 and hinge 31. By moving the stop 26, the maximum height to which roller 25 can be raised can be altered. Although stop 26 is fixed in place, it could be made to be movable.

A generally vertical frame 41 depends from horizontal frame 13. Frame 41 includes vertical frame members 43 which are secured to a horizontal frame end member 17 closest to mounting plate 24 and a bottom frame member 45 which extends between frame members 43. Diagonal reinforcing members 47 extend between the horizontal and vertical frames. Members 47 have one end secured to vertical frame members 43 and another end secured to horizontal frame members 15.

A generally horizontal mounting plate 51 extends between, and is secured to, vertical frame members 43. Linear bearings or bars 53 extend between plate 51 and horizontal frame member 17 and are generally parallel to vertical frame members 43. Preferably, bosses 54 are mounted to plate 51 and frame member 17 which receive the ends of linear bearings 53.

A boss 55 extends upwardly from plate 51 above an opening (not shown) in plate 51. A threaded bar 57 extends through plate 51 and boss 55 such that it may be rotated. A hand wheel 59 is secured to the end of bar 57 below plate 51, and is operatively secured to bar 57 so that bar 57 will be rotated when the wheel 59 is turned.

A bracket 61 is slidably secured to linear bearings 53. Bracket 61 has a horizontal leg 63 and a generally vertical leg or portion 65. Journal boxes 67 are secured to the backs of vertical leg 65 to secure bracket 61 to bearings 53. Journal boxes have bores through which linear bearings 53 extend to allow bracket 61 to slide vertically relative to bearings 53.

An opening (not shown) is formed in bracket leg 63 and an internally threaded boss (such as a nut) 69 is mounted to leg 63 over the opening. Threaded bar 57 is received in boss 69 so that rotation of bar 57 in a first direction will lower bracket 61, and rotation in a second direction will raise the bracket.

Springs 71 extend between bracket 61 and roller frame -27. The springs are connected at one end to bracket horizontal leg 63 and at another end to the pins 37 in the ends 35 of roller frame members 29. Preferably, the springs have hooked ends, which extend through openings in bracket leg 63 and around or through pins 37. By turning wheel 59, bracket 61 will be moved vertically, and the springs will be extended or relaxed, resulting in a change in pressure exerted by the roller 25 against the cushion 3. When the bracket 61 is lowered, springs 71 are extending, increasing the pressure exerted by roller 25 to the bottom of the cushion, and hence a patient's back. When the bracket is raised, the spring is relaxed, and the pressure exerted on the cushion is decreased. The bracket 61, threaded bar 57, and springs 71 thus make up a pressure controlling mechanism which allows the pressure exerted by the roller against a patient to be easily altered.

The stop 26 prevents excess upward movement. Thus, when the spring tension is increased, greater weight or pressure will be required to press the roller downwardly (i.e. greater pressure will be required to overcome the spring tension). Similarly, when the spring tension is reduced, the spring tension will continue to hold the roller against the stop, but less weight or pressure will be required to overcome the spring tension and push the roller downwardly. Thus, when spring tension is increased, the pressure exerted by the roller against the bottom of the cushion is effectively increased, and when spring tension is reduced, the pressure exerted by the roller is effectively reduce.

Further, because the roller frame 27 is pivotally secured to frame 13, the spring 71 allows the roller 25 to follow the curve of virtually any patient's back and will keep the pressure constant along the patient's back. The springs 71 bias the roller upwardly to keep the roller in contact with the bottom of the cushion and to keep the pressure applied by the roller substantially constant at all points along the cushion. Because the roller frame 27 is pivotally mounted to the roller assembly frame 13, spring 71 will keep the roller in contact with the bottom of the cushion 3, no matter what the curvature of the bottom of the cushion. This will allow the operator to give the patient a more even, more comfortable, massage.

Figure 2:
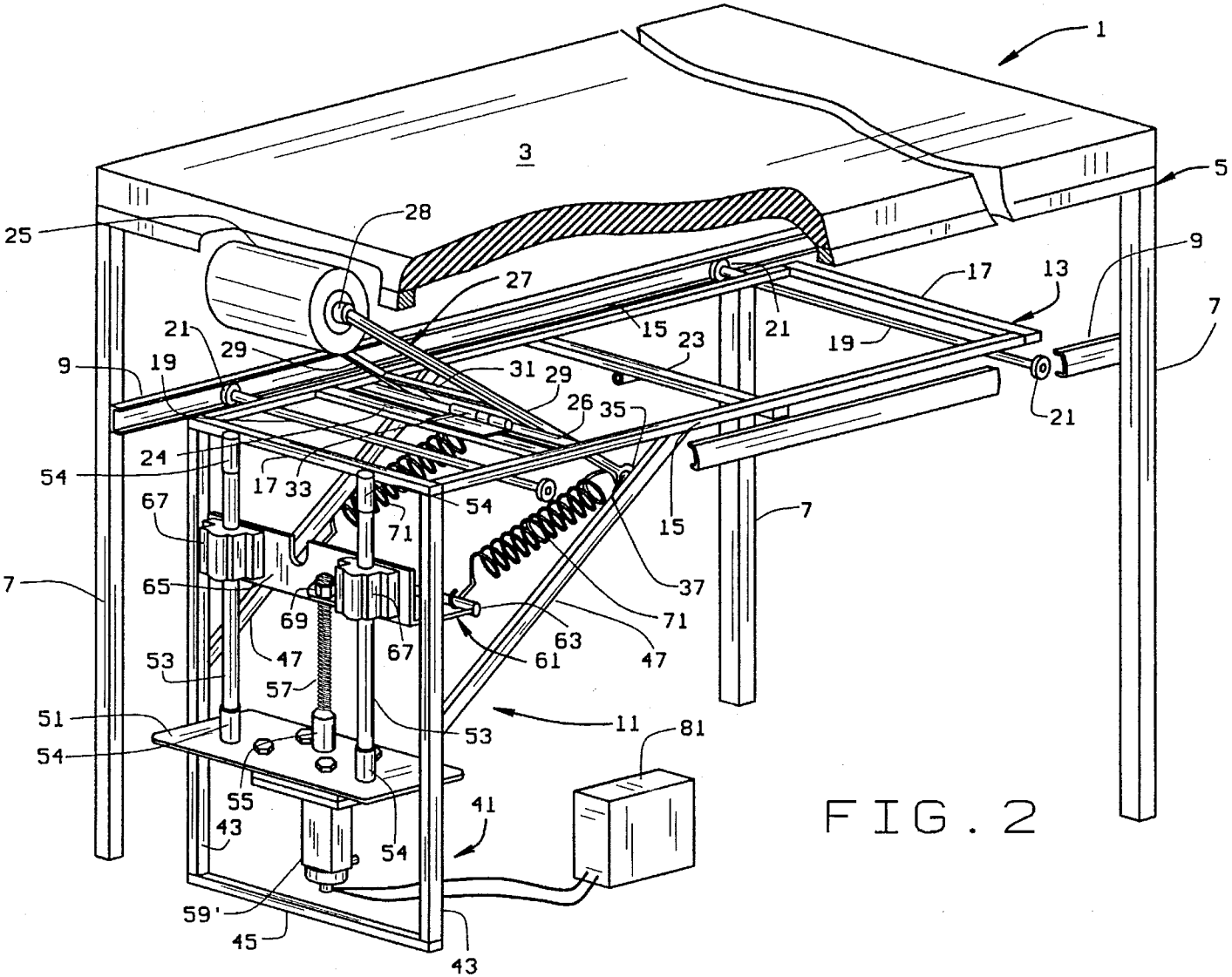
FIG. 2 is a perspective view of the massage table of FIG. 1 wherein the roller mechanism is provided with a motor.

The roller mechanism shown in FIG. 2 is virtually identical to that shown in FIG. 1. However, the turn wheel 59 is replaced by a reversible motor 59'. This will allow the operator to control the pressure exerted by roller 25 electronically and without having to bend down to turn the wheel 59. A motor switch 81 is provided and placed within easy reach of the operator. Switch 81 can, for example, be a finger or foot operated switch. Any type of switch which can activate the motor would be effective.

As can be appreciated, the roller assembly of the present invention allows for the roller to be maintained in contact with the bottom of a massage table cushion regardless of the contours of the cushion, and allows for the effective pressure exerted by the roller on the cushion (the pressure needed to move the roller down) to be constant along the length of the table. This is accomplished even though the roller frame assembly itself is remains at a constant distance from the cushion.

Variations within the scope of the appended claims will be apparent to those skilled in the art in light of the foregoing description and accompanying drawings. Other mechanisms can be used for controlling the pressure exerted by the roller assembly. For example, a hydraulic or pneumatic cylinder can replace the threaded bar 57. The orientation of the elements can also be changed. The plate 51 and wheel 59 or motor 59' could be positioned above bracket 61 and linear bearings 53 could be connected to vertical frame bottom member 45. Threaded boss 69 could be replaced simply with a threaded opening in the bracket leg, if the bracket leg were sufficiently thick. The stop 26 could be formed or placed differently. It could be formed as plates which extend inwardly from the frame member, rather than as a bar. It could also be placed on the diagonal support members 47 rather than on the horizontal frame itself. These examples are merely illustrative.

I claim:

1. A massage table including a table frame and a roller assembly;

said table frame having legs, a cushion supported on said table frame, and two generally straight and horizontal slides secured to said table frame beneath said cushion, said slides extending between a front of said table and a back of said table;

said roller assembly including:

a carriage frame; said carriage frame including a generally horizontal portion and a generally vertical portion; said generally horizontal portion having a front end member, a back end member, side members, a mounting plate extending between said side members; said generally vertical portion having generally vertically extending elongate members depending from said generally horizontal portion; a second mounting plate secured between said vertically extending elongate members; and at least one linear bearing mounted at one end to said second mounting plate and extending generally vertically from said second mounting plate;

wheels rotatably supported on said carriage frame and received in said table frame slides to slidably mount said roller assembly to said table;

a roller mounted to said carriage frame to exert pressure to a bottom surface of said cushion, said roller being movable vertically relative to carriage, and so that said roller can follow curvatures placed in said cushion by a patient lying on said table;

said roller being mounted on a roller frame pivotally mounted to said mounting plate, said roller frame including elongate, spaced-apart side members joined at one end by an axle; a hinge mounting plate secured to said roller frame elongate members intermediate the ends of said elongate frame members; said hinge mounting plate being hingedly connected to said roller assembly mounting plate to pivotally secure said roller frame to said carriage frame; said roller being journaled on said axle; and a tensioning mechanism operable to alter the effective pressure exerted by said roller on said cushion; said tensioning mechanism including a bracket mounted to said at least one linear bearing to be movable vertically relative to said linear bearing and a moving means for raising and lowering said bracket, said tensioning member being secured at a second end to said bracket;

said carriage further including a stop to prevent the roller from being raised above a desired maximum height, said stop being vertically and horizontally spaced from said hinge mounting plate.

2. The massage table of claim 1 wherein the tensioning mechanism includes a tensioning member secured at one end to said roller frame elongate members remote from said roller and at another end to said bracket; said tensioning member being operable to alter the effective pressure exerted by said roller against said cushion.

3. The massage table of claim 2 wherein said tensioning member is a spring.

4. The massage table of claim 1 wherein said moving means for raising and lowering includes a rotatable, externally threaded bar mounted near one end to said second mounting plate and extending through a threaded boss said bracket and means for rotating said threaded bar; wherein when said threaded bar is rotated in a first direction, said bracket is lowered, said tension mechanism is stretched, and pressure exerted by said roller on said cushion is increased; and when said bar is rotated in a second direction, said bracket is raised, said tension mechanism is relaxed, and the pressure exerted by said roller on said cushion is reduced.

5. The massage table of claim 4 wherein said rotating means includes a wheel rotatably fixed to said threaded bar.

6. The massage table of claim 4 wherein said rotating means includes a reversible motor operably connected to said threaded bar.

7. A roller assembly for use with a massage table for providing a massage to a patient lying on the table, the table including a cushion upon which the patient lies; said roller assembly including:

a carriage;

a roller mounted to said carriage to exert pressure to a bottom surface of said cushion, said roller being movable vertically relative to said carriage so that said roller can follow contours placed in said cushion by a patient lying on said table; and a tensioning mechanism operable to alter the effective pressure exerted by said roller on said cushion; said tensioning mechanism including a bracket mounted to at least one linear bearing to be movable vertically relative to said linear bearing and a moving means for raising and lowering said bracket;

wherein said carriage includes a generally horizontal portion having a front end member, a back end member, side members, a mounting plate extending between said side members, and a stop spaced vertically and horizontally from said mounting plate to prevent said roller from being raised above a desired maximum height; and a generally vertical portion having generally vertically extending elongate members depending from said generally horizontal portion; a second mounting plate secured between said vertically extending elongate members; and said at least one linear bearing mounted at one end to said second mounting plate and extending generally vertically from said second mounting plate;

said roller being mounted on a roller frame pivotally mounted to said mounting plate, said roller frame including elongate, spaced-apart side members joined at one end by an axle, said roller being journaled on said axle; said roller frame side members extending over said stop; said roller frame including a plate secured to said roller frame side members intermediate the ends of roller frame side members; said plate being hingedly connected to said carriage mounting plate to pivotally secure said roller frame to said carriage;

a spring secured at one end to an end of said roller frame side member remote from said roller, said spring being secured at a second end to said bracket.

8. The roller assembly of claim 7 wherein said moving means for raising and lowering includes a rotatable, externally threaded bar mounted near one end to said second mounting plate and extending through a threaded boss on said bracket and means for rotating said threaded bar; wherein when said threaded bar is rotated in a first direction, said bracket is lowered, said spring is stretched, and the effective pressure exerted by said roller on said cushion is increased; and when said bar is rotated in a second direction, said bracket is raised, said spring is relaxed, and the effective pressure exerted by said roller on said cushion is reduced.

9. The roller assembly of claim 8 wherein said rotating means includes a wheel rotatable fixed to said threaded bar.

10. The roller assembly of claim 8 wherein said rotating means includes a reversible motor operably connected to said threaded bar.

* * * * *